US006501029B1

(12) United States Patent
Guillemette et al.

(10) Patent No.: US 6,501,029 B1
(45) Date of Patent: Dec. 31, 2002

(54) HIGH-VOLTAGE HOMOGENEOUS CO-CURING COMPOSITE INSULATOR

(75) Inventors: Robert Guillemette, Bellefeuille (CA); Bertrand Legrand, Saint-André (CA)

(73) Assignee: Electro Composites, Inc., Saint Jerome (CA)

( * ) Notice: Subject to any disclaimer, the term of this patent is extended or adjusted under 35 U.S.C. 154(b) by 0 days.

(21) Appl. No.: 09/454,982

(22) Filed: Dec. 3, 1999

(51) Int. Cl.[7] ..... H01B 17/32
(52) U.S. Cl. ..... 174/209; 174/137 B; 174/178
(58) Field of Search ..... 174/209, 141 R, 174/137 B, 148, 205, 207, DIG. 1, 171, 176, 177, 178, 179, 195

(56) References Cited

U.S. PATENT DOCUMENTS

| | | | | | |
|---|---|---|---|---|---|
| 1,451,968 | A | * | 4/1923 | Steinberger | 174/209 |
| 1,764,418 | A | * | 6/1930 | Schramm | 174/209 |
| 1,764,419 | A | * | 6/1930 | Schramm | 174/209 |
| 2,924,643 | A | * | 2/1960 | Barnes | 174/178 |
| 3,213,254 | A | * | 10/1965 | Strom | 174/209 |
| 3,495,027 | A | * | 2/1970 | Lambeth et al. | 174/209 |
| 3,586,758 | A | * | 6/1971 | Harmon | 174/169 |
| 3,878,321 | A | | 4/1975 | Ely | |
| 3,898,372 | A | * | 8/1975 | Kalb | 174/179 |
| 4,045,604 | A | | 8/1977 | Clabburn | |
| 4,217,466 | A | | 8/1980 | Kuhl | |
| 4,312,123 | A | | 1/1982 | Wheeler | |
| 4,331,833 | A | * | 5/1982 | Pargamin et al. | 174/179 |
| 4,897,027 | A | | 1/1990 | Szaplonczay et al. | |
| 5,159,158 | A | * | 10/1992 | Sakich et al. | 174/179 |
| 5,233,132 | A | * | 8/1993 | Soucille | 174/179 |
| 5,298,301 | A | | 3/1994 | Midgley et al. | |
| 5,425,973 | A | | 6/1995 | Frangipane et al. | |
| 5,877,453 | A | | 3/1999 | Hill | |
| 5,902,963 | A | * | 5/1999 | Chappaz et al. | 174/167 |

OTHER PUBLICATIONS

Filament Winding; W.D. Humphrey, pp. 368–377, No date.

* cited by examiner

*Primary Examiner*—Anthony Dinkins
*Assistant Examiner*—Adolfo Nino
(74) *Attorney, Agent, or Firm*—Selitto, Behr & Kim

(57) ABSTRACT

A high-voltage homogeneous co-curing composite insulator includes first and second end fittings longitudinally separated by a spacer, a resin impregnated fiber core wound onto the end fittings and onto the spacer, and an outer sheath moulded onto the fiber core. Since the resin matrix of the core and the material used to form the outer sheath each include curable resins from the same family and are, therefore, chemically compatible, a chemical link exists between these two elements. The end fittings are provided with a relatively thin wall defining a mechanical fuse.

11 Claims, 5 Drawing Sheets

HIGH-VOLTAGE HOMOGENEOUS CO-CURING COMPOSITE INSULATOR

FIELD OF THE INVENTION

The present invention relates to high voltage insulators. More specifically, the present invention is concerned with a high-voltage insulator made of composite materials. The present invention is also concerned with a method of manufacturing such a high-voltage composite insulator.

BACKGROUND OF THE INVENTION

Typically, high-voltage insulators include an elongated core made of an electrically insulating material such as porcelain or fiberglass. The ends of the elongated core are provided with respective metal fittings while the length of the core is covered with a polymeric outer sheath defining convolutions to increase the creepage distance between the metal fittings.

These conventional high-voltage insulator suffer many drawbacks. For example, when the elongated core is made of porcelain, it is relatively heavy and brittle. On the other hand, when the elongated core is made of a fiberglass rod, the resulting insulator is relatively weak when torsional forces are applied thereto since the fibers are longitudinally oriented.

Furthermore, in both cases, since the polymeric material forming the outer sheath and the material forming the elongated core are not chemically compatible, the interface between these two elements is purely mechanical and may thus be broken. It is also to be noted that failure of the high-voltage insulator would occur should water infiltrate the insulator through the interface between the outer sheath and the elongated core.

A third drawback of conventional high-voltage insulators is that it is not usually possible to visually determine when the elongated core of the insulator has been broken due to excessive forces applied thereto. Indeed, since the elongated core is covered by an outer sheath usually made of a relatively flexible material, the core may break without breaking the outer sheath.

OBJECTS OF THE INVENTION

An object of the present invention is therefore to provide an improved high-voltage composite insulator.

SUMMARY OF THE INVENTION

More specifically, in accordance with the present invention, there is provided a high-voltage composite insulator comprising:

first and second fittings; the first and second fittings being spaced apart along a longitudinal axis;

a spacer positioned between the first and second fittings;

a resin impregnated fiber core wound onto the first and second fittings and onto the spacer; the core including fibers and a resin matrix; and an outer sheath mould onto the resin impregnated fiber core; the outer sheath being made of a material chemically compatible with the resin matrix of the core to thereby create a chemical link between the resin impregnated core and the outer sheath.

According to another aspect of the present invention, there is provided a method of making a high-voltage composite insulator comprising:

providing a first fitting;

providing a second fitting;

providing a spacer;

mounting the spacer between the first and second fittings;

winding fibers impregnated with a resin matrix onto the first and second fittings and onto the spacer to form a core;

moulding an outer sheath onto the core; the outer sheath being made of a composite material that is chemically compatible with the resin matrix of the core; and co-curing the core and the outer sheath to create a chemical link between the core and the outer sheath.

According to yet another aspect of the present invention, there is provided a high-voltage composite insulator comprising:

first and second fittings; the first and second fittings being spaced apart along a longitudinal axis; each the first and second fittings including an anchoring portion having a generally rounded geometric shaped cross-section;

a spacer mounted between the first and second fittings;

a resin impregnated fiber core wound onto the first and second fittings and onto the spacer; and an outer sheath mould onto the resin impregnated fiber core.

According to a final aspect of the present invention, there is provided a high-voltage composite insulator comprising:

first and second fittings; the first and second fittings being spaced apart along a longitudinal axis; one of the first and second fittings having a relatively thin wall portion;

a spacer mounted between the first and second fittings;

a resin impregnated fiber core wound onto the first and second fittings and onto the spacer; and an outer sheath mould onto the resin impregnated fiber core;

wherein the relatively thin wall portion of one of the first and second end fittings is generally weaker than both the resin impregnated fiber core and the outer sheath, thereby creating a mechanical fuse.

Other objects, advantages and features of the present invention will become more apparent upon reading of the following non restrictive description of preferred embodiments thereof, given by way of example only with reference to the accompanying drawings.

BRIEF DESCRIPTION OF THE DRAWINGS

In the appended drawings

DESCRIPTION OF THE PREFERRED EMBODIMENT

Figure 2:
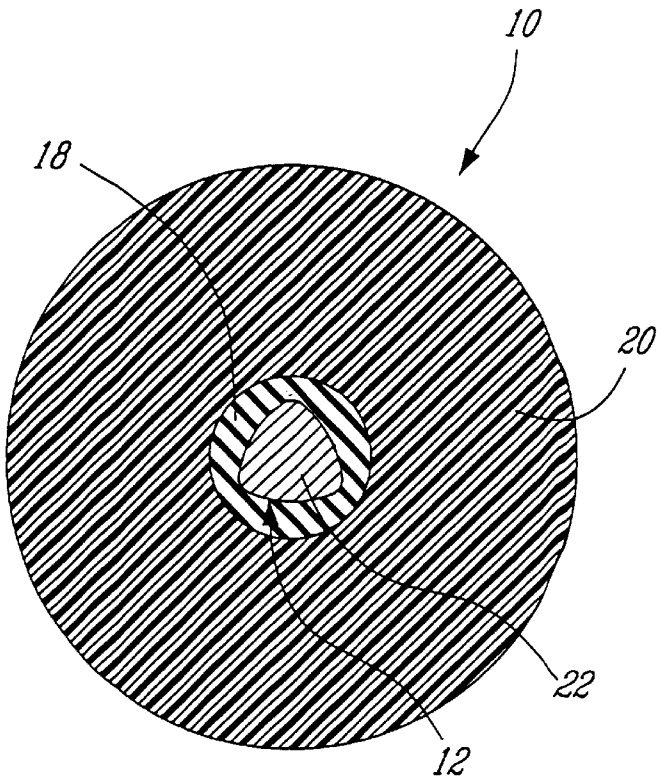
FIG. 2 is a sectional view taken along line 2—2 of FIG. 1.
Figure 1:
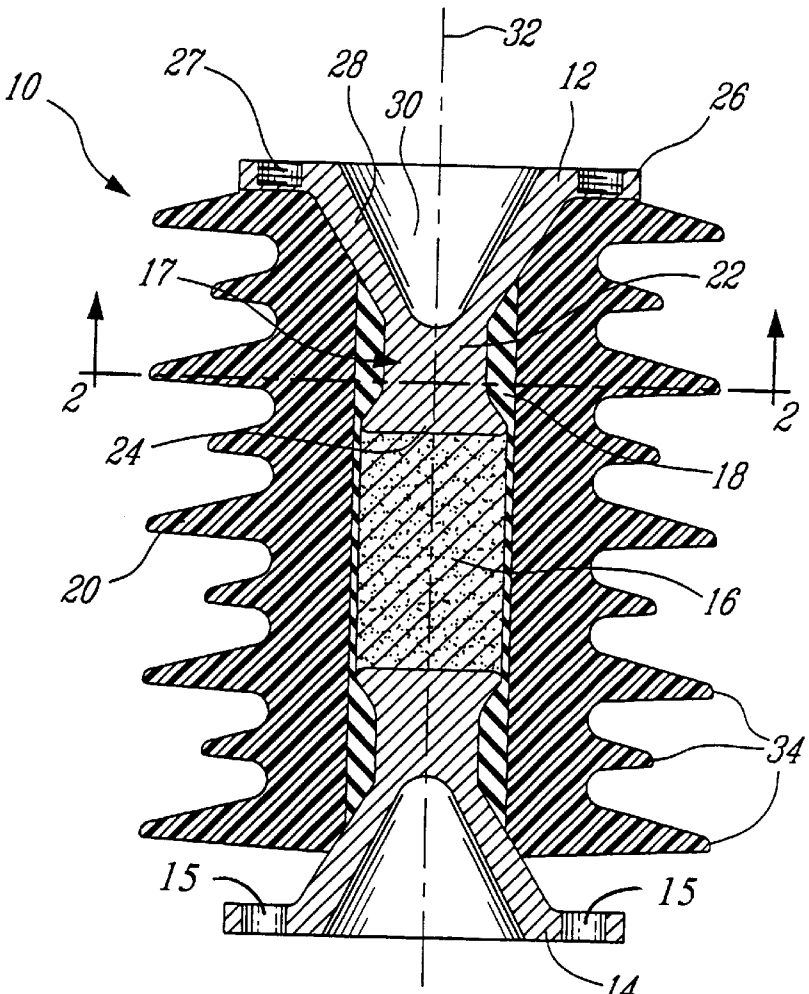
FIG. 1 is a sectional side elevational view illustrating a high-voltage composite insulator according to an embodiment of the present invention.

Turning now to FIGS. 1 and 2 of the appended drawings, a high-voltage composite insulator according to a preferred embodiment of the present invention will be described.

As will be understood by one skilled in the art upon reading the following description, even though a column insulator 10 is illustrated in FIGS. 1 and 2 other types of high-voltage composite insulators may be constructed according to the present invention.

The high-voltage composite insulator 10 includes two end fittings 12 and 14, a generally cylindrical spacer 16, a core 18 and an outer sheath 20. The two end fittings 12 and 14 defining, with the spacer 16, a reel-type assembly 17.

As can be seen from FIG. 1, the end fitting 12 includes an anchoring portion 22, an outer flange 26 and a flaring portion 28 integrally joining the anchoring portion 22 to the flange 26. The anchoring portion 22 is provided with a wider inner end 24, the purpose of which will be described hereinbelow. Since the flaring portion 28 is hollowed by a generally conical depression 30, the end fitting 12 has a generally Y-shape cross-section.

The outer flange 26 of the end fitting 12 includes threaded apertures 27 allowing the high-voltage insulator 10 to be stacked or conventionally mounted to electrical equipment. Of course, the apertures 27 could be different from the ones shown should the use of the high-voltage insulator require it.

The end fitting 14 is very similar to the end fitting 12, therefore, only the differences between these two elements will be described hereinbelow. The major difference, related to the use of the column insulators that are often stacked, concerns the apertures 15 of the end fitting 14 that go through the flange and that are not threaded.

It is to be noted that another optional difference between the end fittings 12 and 14 is that only one of these fittings is required to include the depression 30, or any other suitable type of depression, to provide a mechanical fuse feature as will be described hereinbelow.

As is apparent from FIG. 1, the core 18 mechanically interconnects the two end fittings 12 and 14. Two features of the end fittings increase the quality of this interconnection.

First, the cross-sectional profile of the anchoring portion 22 generally defines a rounded triangle (see FIG. 2), thereby preventing the end fitting 12 from rotating with respect to the core 18. Furthermore, the rounded triangular cross-sectional profile of the anchoring portion 22 also provides a non angled surface onto which the core will be wound. This profile, having no sharp edge, is advantageous since it reduces the occurrences of core fiber breaks during the winding process, resulting in a stronger core.

It is to be noted that the cross-sectional profile of the anchoring portion 22 could be another rounded geometric shape as long as it is not continuous (e.g. a circle) or provided with sharp edges that would promote fiber breaks.

Second, the wider inner portion 24 and the beginning of the flaring portion 28 create a circumferential channel in which a portion of the core 18 is wound, thereby preventing the end fitting 12 from moving longitudinally with respect to the core 18.

Another interesting feature of the end fitting 12 is that the flaring portion 28 is defined by a relatively thin wall that may be designed to be the weakest portion of the high-voltage composite insulator 10 to thereby act as a mechanical fuse. Indeed, it is believed to be within the reach of one of ordinary skill in the art to design an insulator according to the present invention where the thickness of this wall is determined so that it is slightly weaker than the other elements of the insulator to ensure that the flaring portion 28 will be the first element to break, should excessive mechanical stress be applied to the insulator 10. This is an advantage since the flaring portion is visible through the depression 30, thereby enabling visual inspection of the insulator for mechanical failure.

The end fittings 12 and 14 are advantageously made of metals that are suited for outdoor use such as, for example, aluminium or zinc plated steel. Of course, other materials could be used.

The spacer 16 is advantageously made from a light dielectric material such as, for example, low density polyurethan foam. Of course, other materials could be used such as, for example, a fiberglass-epoxy rod, a hollow core or even a washable core that could be removed after the completion of the insulator through optional apertures (not shown) of the end fittings 12 and 14.

The function of the spacer 16 is to maintain the spacing between the two end fittings 12 and 14 during the assembly of the high-voltage composite insulator 10 as will be described hereinbelow.

The core 18 is wound directly onto the reel-type assembly 17, preferably by a conventional wet filament winding process, as will be described hereinbelow.

The core 18 is advantageously made of a resin impregnated continuous fiber, such as, for example, fiberglass. Indeed, the use of a continuous fiber allow the core 18 to be wound without joints in the fiber. Of course, other processes or other types of fibers could be used to form the core 18.

The winding pattern of the fiber onto the core 18 may vary. However, it has been found advantageous to wind a portion of the thickness of the core 18 so that the fiber has a wind angle, when measured from the longitudinal axis 32, continuously varies from about 90 degrees at both ends of the core 18 to about 50 degrees at the center of the core 18. This winding pattern is interesting since it is circumferential over the end fittings 12 and 14, where it is advantageous to provide improved longitudinal strength to the core 18, and it is angled over the spacer 16, where it is advantageous to provide improved torsional and lateral strengths to the core 18. Of course, the outer layers of fibers could be wound at nearly 90° along the entire length of the core to improve the anti-buckling characteristics of the insulator 10.

Of course, the above described winding pattern may not be advantageous for every types and dimensions of high-voltage composite insulator.

It is believed that one skilled in the art may determine the fiber content of the core 18 according to the insulator dimensions and intended use, for example.

According to a preferred embodiment of the present invention, the matrix resin used to bind the fibers of the core together is a thermoset resin system such as, for example, an epoxy-based resin.

The outer sheath 20 includes a plurality of circumferential skirts 34 conventionally used to increase the creepage distance between the end fittings 12 and 14. Of course, the rounded shape of the skirts 34 is given herein as an example only since other configuration of these skirts could be used as long as they provide an adequate creepage distance between the end fittings 12 and 14.

According to a preferred embodiment of the present invention, the material used to form the outer sheath 20 is a thermoset resin system such as, for example an epoxy-based resin. Indeed, it has been found advantageous to use a material that is chemically compatible with the matrix used to form the composite material of the core 18 since it greatly improves the strength of the interface between the core 18 and the outer sheath 20, creating a chemical bond instead of a purely mechanical bond, as will be described hereinbelow.

Turning now to FIGS. 3 to 7 of the appended drawings, a method for making a high-voltage composite insulator according to the present invention will be described.

Figure 3:
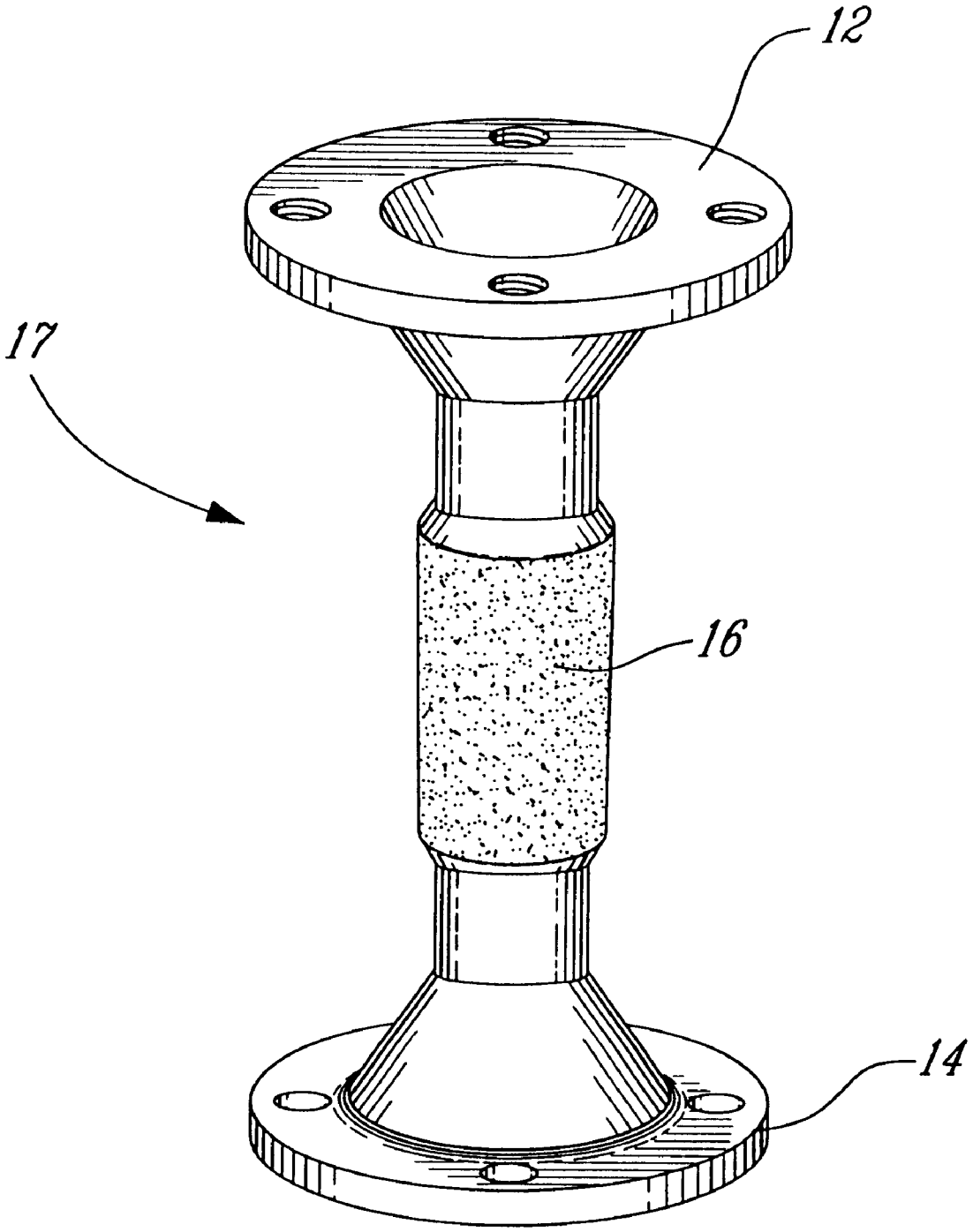
FIG. 3 is a perspective view illustrating two metal fittings of the high-voltage composite insulator of FIG. 1, mounted to a spacing element to form a reel-type assembly.

The first step to make a high-voltage composite insulator according to the present invention is to assemble the two end fittings 12 and 14 to distal ends of the spacer 16, to yield the reel-type assembly 17 illustrated in FIG. 3. This is carried out on the winding machine illustrated in FIG. 4. More specifically, the outer ends of the fittings 12 and 14 are so mounted to the machine as to be coaxial and the spacer 16 is mounted between the inner ends of the fittings 12 and 14.

The second step is to wound the core 18 onto the reel-type assembly 17. According to a preferred embodiment of the present invention, a wet winding process is used to wind a fiber strand onto the reel-type assembly. In a nutshell, a wet winding process is a winding process where the continuous fiber strand is impregnated with resin immediately before it contacts the base piece onto which it is wound.

Figure 4:
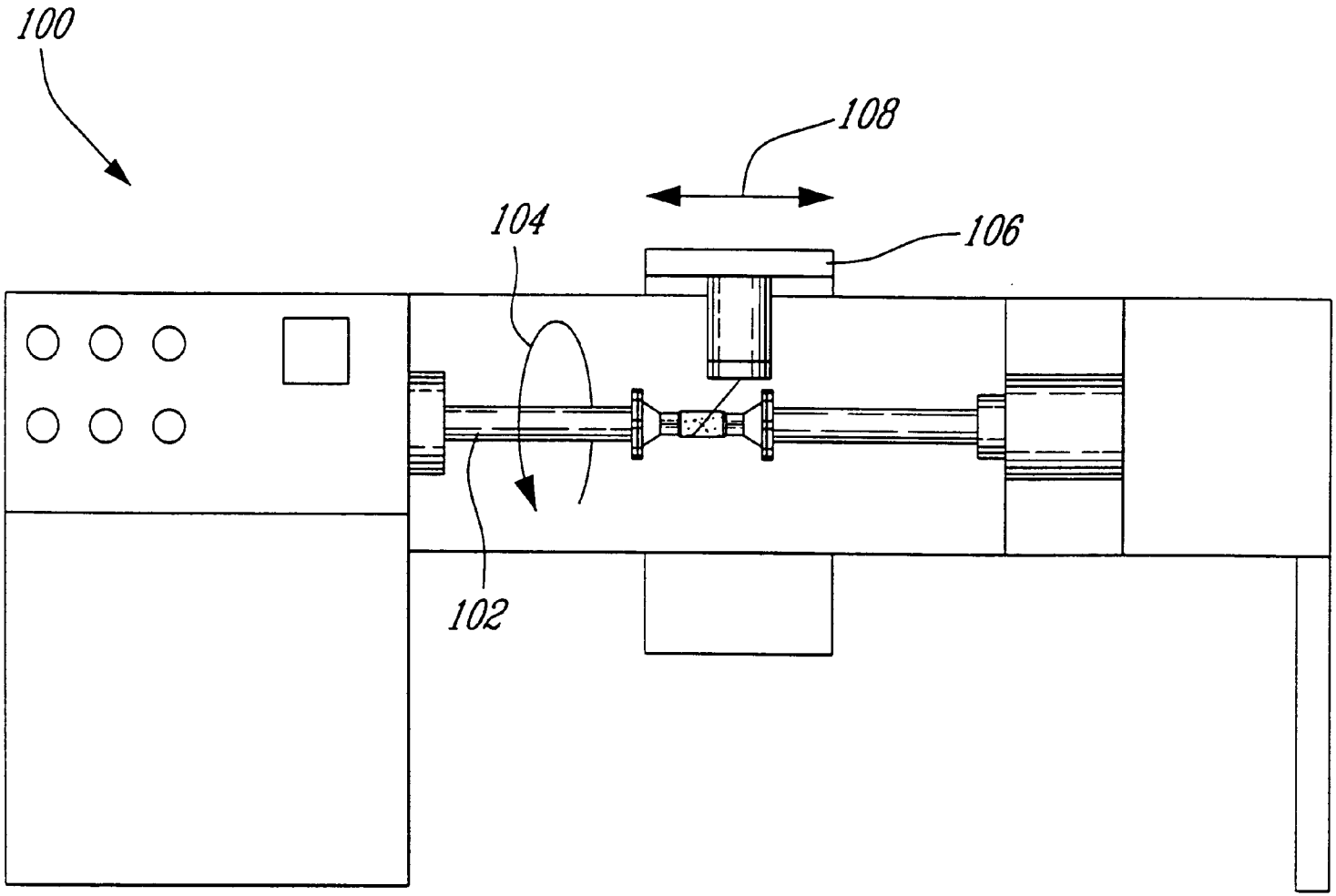
FIG. 4 is a schematic side elevational view of a wet fiber winding machine.

FIG. 4 of the appended drawings schematically illustrates a wet winding machine 100 used to wind the core 18. The synchronisation between the rotation of the mandrel 102 of the machine 100 (see arrow 104) and the longitudinal displacement of the winding head 106 (see double arrow 108) enables the core 18 to be wound according to a predetermined winding pattern.

As discussed hereinabove, many winding patterns could be used to form the core 18.

Filament winding machines and processes are believed well known in the;art and will therefore not be further discussed herein.

The Filament Winding System W65 commercialized by McClean Anderson, a division of Industrial Service & Machine, Inc., has been found adequate to wind the core 18.

Figure 5:
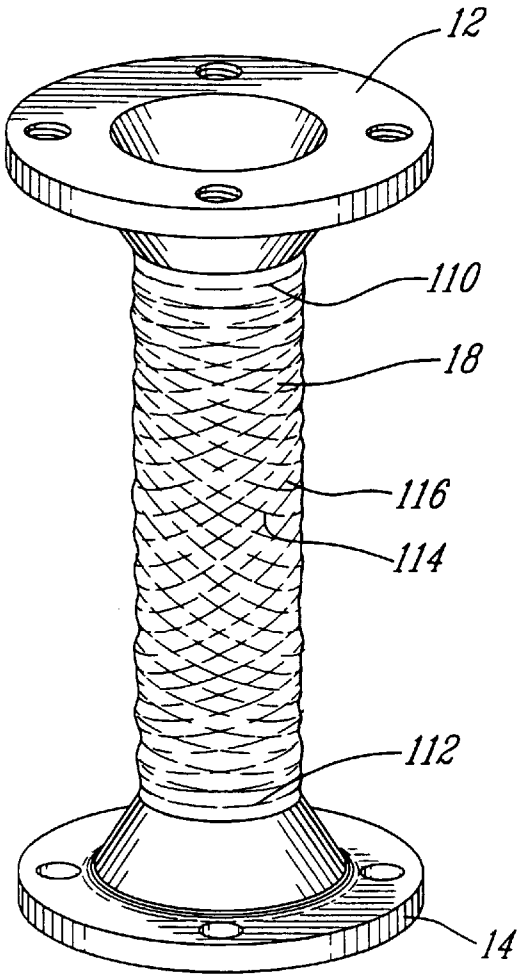
FIG. 5 is a perspective view schematically illustrating the reel-type assembly of FIG. 3 onto which wet fiber has been wound to yield a composite insulator core without sheath.

FIG. 5 schematically illustrates the result of the winding step. This figure clearly illustrates that the winding angle continuously changes from about 90 degrees when the fibres overlay either fittings 12 and 14, i.e., at each end of the core (see for example filaments 110 and 112 provided at opposite ends of the core 18) to about 50 degrees when the fibers overlay a central portion of the spacer 16 (not shown), i.e., at the center of the core (see for example filaments 114 and 116 at the center of the core 18). It is to be noted that the above described winding pattern has been applied to the entire thickness of the core 18, which is a design choice, not a required feature.

The last step in the production of the high-voltage composite insulator is the molding of the outer sheath 20 directly onto the core 18. This step is executed after the winding step, i.e. before the resin matrix of the core 18 is completely cured. Indeed, as explained hereinabove, since the material forming the matrix of the core 18 and the material forming the sheath 20 are chemically compatible, for example they are from the same resin families, it is advantageous to mold the sheath while the core is not completely cured to thereby co-cure the core 18 and the outer sheath 20. This is advantageous since it yields a stronger interface between the core and the sheath to thereby prevent unwanted separation of these portions of the high-voltage composite insulator since a chemical link is created between the resin impregnated core and the outer sheath.

Figure 6:
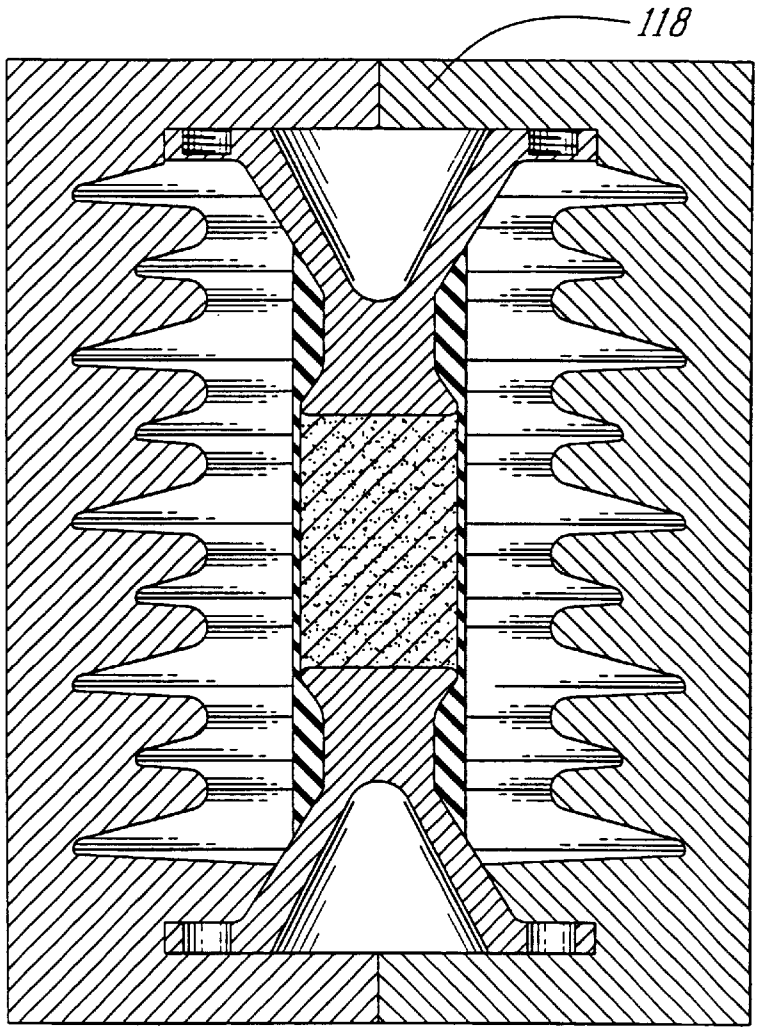
FIG. 6 is a sectional view of the insulator core of FIG. 5 placed in a mold cavity to mold the outer sheath.

FIG. 6 schematically illustrates the insulator core of FIG. 5 placed in a two-part mold 118 to mold the outer sheath 20 of the high-voltage insulator and to co-cure the core 18 and the sheath 20.

Of course, as will easily be understood by one skilled in the art, the type of mold may vary and the curing time and conditions are to be determined according, for example, to the type of material used and to the size of the insulator. Since these considerations are believed well known to one skilled in the art, they will not be further described herein.

Figure 7:
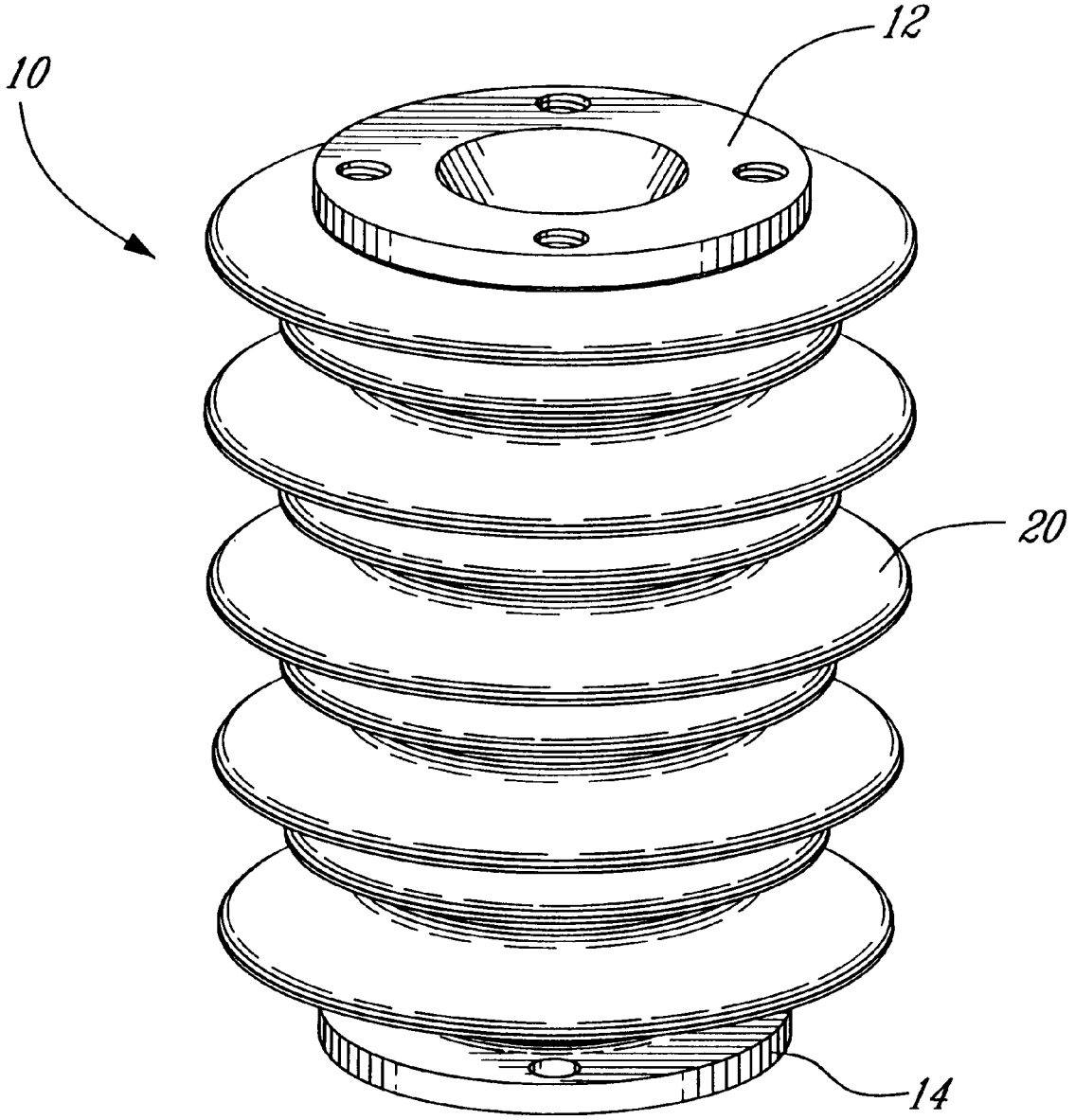
FIG. 7 is a perspective view illustrating a completed high-voltage composite insulator according to an embodiment of the present invention.

Finally, FIG. 7 is a perspective view illustrating a completed high-voltage composite insulator, under the form of a column insulator 10 according to a preferred embodiment of the present invention.

Although the present invention has been described hereinabove by way of preferred embodiments thereof, it can be modified, without departing from the spirit and nature of the subject invention as defined in the appended claims.

What is claimed is:

1. A high-voltage composite insulator comprising:

first and second fittings; said first and second fittings being spaced apart along a longitudinal axis;

a spacer positioned between said first and second fittings;

a resin impregnated fiber core wound onto said first and second fittings and onto said spacer; said core including fibers and a resin matrix; and a resin outer sheath moulded onto said resin impregnated fiber core, wherein said resin impregnated fiber core and said resin outer sheath each include curable resins from the same family, thereby creating a chemical link between said resin impregnated core and said outer sheath.

2. A high-voltage composite insulator as recited in claim 1, wherein said resin matrix is a thermoset resin.

3. A high-voltage composite insulator as recited in claim 2, wherein said thermoset resin is an epoxy-based resin.

4. A high-voltage composite insulator as recited in claim 1, wherein said material forming said outer sheath is a thermoset resin.

5. A high-voltage composite insulator as recited in claim 4, wherein said thermoset resin is an epoxy-based resin.

6. A high-voltage composite insulator comprising:

first and second fittings; said first and second fittings being spaced apart along a longitudinal axis; each said first and second fittings including an anchoring portion having a generally rounded geometric shaped cross-section;

a spacer mounted between said first and second fittings;

a resin impregnated fiber core wound onto said first and second fittings and onto said spacer; and a resin outer sheath moulded onto said resin impregnated fiber core, wherein said resin impregnated fiber core and said resin outer sheath each include curable resins from the same family.

7. A high-voltage composite insulator as recited in claim 6, wherein said anchoring portion has a generally rounded triangular shaped cross-section.

8. A high-voltage composite insulator as recited in claim 6, wherein each said first and second fittings is provided with a circumferential channel in which a portion of said core is wound.

9. A high-voltage composite insulator as recited in claim 8, wherein each circumferential channel includes a wider inner end and said anchoring portion.

10. A high-voltage composite insulator comprising:

first and second fittings; said first and second fittings being spaced apart along a longitudinal axis; one of said first and second fittings having a relatively thin wall portion;

a spacer mounted between said first and second fittings;

a resin impregnated fiber core wound onto said first and second fittings and onto said spacer; and a resin outer sheath moulded onto said resin impregnated fiber core, wherein said resin impregnated fiber core and said resin outer sheath each include curable resins from the same family;

wherein said relatively thin wall portion of one of said first and second fittings is generally weaker than both said resin impregnated fiber core and said outer sheath, thereby creating a mechanical fuse.

11. A high-voltage composite insulator as recited in claim 10, wherein one of said first and second fittings includes:

an anchoring portion;

a flange portion; and a flaring portion integrally interconnecting said anchoring portion and said flange portion; said flaring portion being hollowed to form said relatively thin wall portion.

* * * * *